US005479250A

United States Patent [19]

Michlin

[11] Patent Number: 5,479,250

[45] Date of Patent: Dec. 26, 1995

[54] PHOTORECEPTOR DRUM KEEPER BLADE IMPROVEMENT

[76] Inventor: Steven B. Michlin, 5310 Bentley Suite 105, West Bloomfield, Mich. 48322

[21] Appl. No.: 321,550

[22] Filed: Oct. 11, 1994

Related U.S. Application Data

[63] Continuation-in-part of Ser. No. 101,016, Aug. 3, 1993, Pat. No. 5,400,128.

[51] Int. Cl.[6] ..... G03G 21/10

[52] U.S. Cl. ..... 355/296; 355/299

[58] Field of Search ..... 355/299, 298, 355/296, 245; 118/652; 15/256.5, 256.51

[56] References Cited

U.S. PATENT DOCUMENTS

| | | | |
|---|---|---|---|
| 4,527,887 | 7/1985 | Vineski | 118/652 X |
| 4,530,594 | 7/1985 | Adachi | 15/256.5 X |
| 4,561,766 | 12/1985 | Fox | 15/256.5 X |
| 4,711,561 | 12/1987 | Tsuruoka | 118/652 X |
| 4,730,205 | 3/1988 | Ogiri et al. | 118/652 X |
| 4,888,620 | 12/1989 | Fujino et al. | 355/296 X |
| 4,891,679 | 1/1990 | Saijo | 355/298 |
| 4,939,551 | 7/1990 | Hashiyama et al. | 355/299 |
| 4,947,216 | 8/1990 | Surti | 355/299 |
| 5,038,181 | 8/1991 | Yoshida et al. | 355/299 |
| 5,107,304 | 4/1992 | Haneda et al. | 355/296 |
| 5,363,182 | 11/1994 | Kuribayashi et al. | 355/299 |
| 5,406,365 | 4/1995 | Baba et al. | 355/298 |

*Primary Examiner*—R. L. Moses

[57] ABSTRACT

A stiffener which extends the life of a keeper blade used in toner cartridge assemblies to provide a seal with the photoreceptor drum between the waste toner hopper and the remainder of the cartridge assembly. The stiffener is attached along the length of the keeper blade and is also used to secure the keeper blade to the waste toner hopper. Two sides of the stiffener are provided with an adhesive, such as a two-sided tape. One side of the stiffener is attached to the keeper blade, and then the other side of the stiffener is used to secure the keeper blade to the waste toner hopper. The thickness of the stiffener is selected to set the distance between the keeper blade and the photoreceptor drum. The stiffener is made of a resilient material which may also be conductive. So the stiffener will not kink during cleaning or other maintenance and will conduct heat away from the keeper blade to prevent the blade from warping. In another embodiment, the keeper blade itself is made of or coated with a conductive material to extend the life of the blade.

20 Claims, 2 Drawing Sheets

FIG - 1
PRIOR ART
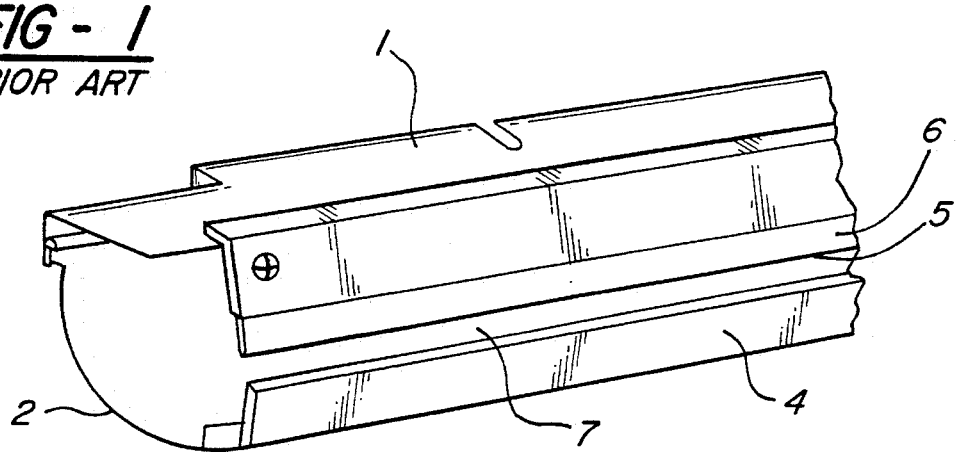
FIG - 2
PRIOR ART
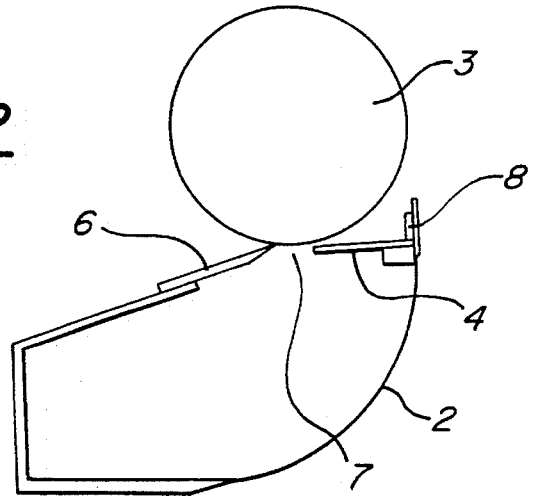
FIG - 3
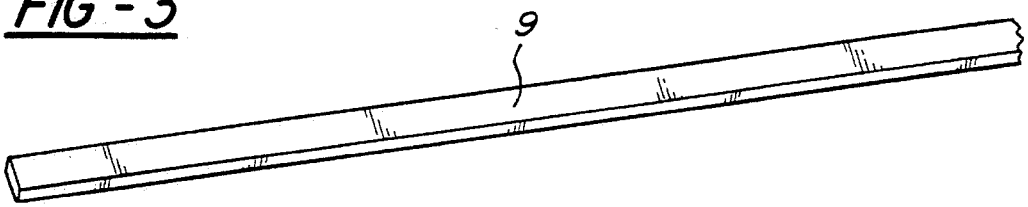
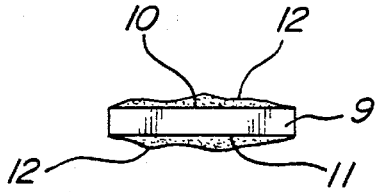
FIG - 4
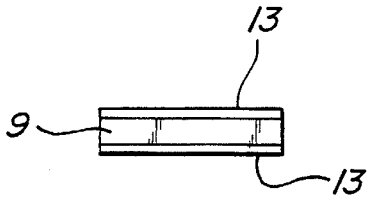
FIG - 5

PHOTORECEPTOR DRUM KEEPER BLADE IMPROVEMENT

BACKGROUND OF THE INVENTION

This invention is a continuation-in-part of application Ser. No. 08/101,016 filed Aug. 3, 1993, now U.S. Pat. No. 5,400,128.

This invention relates to solving problems on photoreceptor drum keeper blades used in Xerography and more specifically in the toner cartridge remanufacturing industry. This includes copiers, laser printers and facsimile machines which will be referred to throughout this text as imaging machines. However, it should be noted that the scope of this invention is not limited to imaging machines that use toner cartridges but includes all dry toner copiers, laser printers and facsimile machines.

CANON has designed an all-in-one cartridge as seen in U.S. Pat. No. 4,975,744, issued Dec. 4, 1990 and assigned to CANON. Several companies have used these cartridges in laser printers, copy machines and facsimile machines, each with the varying printer engines and a different nameplate. Originally, these cartridges were designed to be "disposable". However, after the first all-in-one toner cartridge was introduced, it did not take long before laser cartridge remanufacturers such as myself began remanufacturing these cartridges. These "disposable" cartridges were designed to function for only one cartridge cycle without remanufacturing. The remanufacturers had found certain components that needed replacement on a regular basis. In 1990, the first aftermarket photoreceptor drum became available for use in remanufacturing the all-in-one cartridge of the "SX" engine variety, the most popular printer cartridge from around 1987 through 1994 at the time of this writing. When the long-life photoreceptor drum became available, the entire remanufacturing industry turned around and gained great strength and began a huge growth surge that still continues. In October 1993, HEWLETT-PACKARD, the largest seller of this printer engine using the all-in-one cartridge, entered the cartridge remanufacturing industry with the "OPTIVA" cartridge, further increasing the size as well as credibility of this relatively new industry. However, this relatively new industry grew from the all-in-one cartridge shortly after its debut. Before the introduction of the long-life drum, sometimes called the "superdrum" or "duradrum", the SX cartridge would last for around three cartridge remanufacturing cycles at best, since the actual useful life of the OEM drum was three cycles. However, the long-life drums got their names from the fact that they were designed to last for many remanufacturing cycles or recharges as they are sometimes called. Typically, the long life drum can last for ten or more such cycles, unlike the typical OEM(Original Equipment Manufacturer) drum. With the additional developments of drum coatings, originally designed for OEM drums, the long-life drum may last for many additional cycles. Some coatings, in theory, were designed to be dissolved and removed from over the drum surface every 1–3 cycles, so the drum life of the long-life drum almost seems limitless.

However, with photoreceptor drums lasting for many cycles, other components of the cartridge have a tendency to require greater durability, a better solution, or a greater life. Also, as the success of these cartridges has skyrocketed, the demand is for cartrides with longer cycles, so component improvements are significant. Therefore, avoiding natural problems with prevention means must also be implemented for cartridges of longer life both in longer cycle times and greater number of cycles. One good example is the keeper blade used in imaging machines. The keeper blade is a blade on the waste toner hopper that rubs on the photoreceptor drum and keeps the toner in. It is essentially a seal to prevent toner leakage. As the photoreceptor drum rotates, after transferring the dry toner image from the drum to the paper, it then in theory should be toner free. However, residual waste toner is left on the drum. As the drum rotates, it rotates with the residual toner on the photoreceptor drum in contact with the keeper blade, forming a perfect seal, however, as it continues to rotate, it then is scraped off by the cutting edge of the wiper blade, and falls into the waste toner hopper. A perfect seal is maintained between the wiper blade and the photoreceptor drum so toner does not leak out of the waste toner hopper. Similarly, a perfect seal is maintained between the keeper blade and the photoreceptor drum so that toner will not leak out of the waste toner hopper.

There are problems associated with the use of the keeper blade. The waste toner hopper periodically needs to be vacuumed or otherwise cleaned between cartridge cycles because of an accumulation of toner in the waste toner hopper. This toner can foul the rest of the toner cartridge assembly and the office environment and get all over the printer or copier, if it is not vacuumed between each cartridge remanufacturing cycle. But the keeper blade sometimes kinks or becomes bent due to this vacuuming or due to maintenance done on adjacent assembly components. The keeper blades often become kinked during the keeper blade replacement process because if it is slightly misplaced, peeling it back up to adjust its location will kink it. The keeper blade also can warp or fail in some other manner because of excessive heat generated during the repeated operation of the cartridge assembly and the imaging machine. This kinking or warping lowers or destroys the effectiveness of the seal function provided by the keeper blade onto the photoreceptor drum. In some cartridge assemblies, the keeper blade is too far from the photoreceptor drum to form a good seal as the keeper blade ages due to warping, also causing leakage.

Most keeper blades are made of plastic of extremely thin dimensions, around 3–4 thousandths of an inch. Such thin keeper blades have two major problems. First, they are so thin, they kink when vacuuming the waste toner hopper clean, an operation performed every cartridge remanufacturing cycle. Second, the plastic keeper blades thus replaced every cycle are difficult to install, being so thin, are also difficult to handle, particularly during installation. It is difficult to install straight and thus, after installation, they must be removed and reapplied when not placed accurately. However, even removing a portion of the blade cause a kink in the new blade, thus causing the problem the new blade was supposed to prevent, and thus many new blades get ruined using the prior art, thin keeper blade technology. One solution to this problem has been a holding tool to place the keeper blade accurately onto the waste toner hopper. However, this tool is not practical when using this invention because in one embodiment, thick blades may be used, thus direct installation may be performed quicker than thin blades may be placed into the holding tool, thus saving time.

In applicant's U.S. Pat. No. 5,237,375, a stiffener for a wiper blade was disclosed. Applicant's copending application Ser. No. 08/101,016, filed Aug. 3, 1993, now U.S. Pat. No. 5,400,128, describes coating doctor and wiper blades with heat conductive materials to extend their lives. But the problems specifically associated with keeper blades have not been addressed.

SUMMARY OF THE INVENTION

Accordingly, it is an object of this invention to improve the keeper blade used in toner cartridge assemblies for imaging machines to provide a seal between the waste toner hopper and the photoreceptor drum.

It is another object of this invention to provide a stiffener for the keeper blade which is resilient enough to prevent the blade from kinking during cleaning or other maintenance and from failing during repeated operation of the imaging machine and to prevent toner from leaking into the toner cartridge assembly from the waste toner hopper.

It is still another object of this invention to provide a stiffener to a keeper blade which is heat conductive so heat will be conducted away from the keeper blade and the blade will not warp during repeated use of the imaging machine.

It is a further object of this invention to provide a keeper blade with an easily attachable stiffener which is also used to secure the blade to the toner cartridge assembly adjacent the waste toner hopper.

A still further object of this invention is to provide a keeper blade with a stiffener that also acts as a shim in setting the distance of the keeper blade from the photoreceptor drum to make a better toner seal, made of plastic or rubber.

An additional object of this invention is to provide a keeper blade which is heat conductive so the blade will not warp during repeated operation of the imaging machine. The heat conductive keeper blade may be made of a conductive plastic, a conductive rubber, a conductive urethane rubber, a conductive plastic coated with a conductive coating, or a conductive rubber coated with a conductive coating.

It is thus an object of this invention to provide a keeper blade with an almost negligible failure rate with a much longer useful life span, by preventing kinking, warping, or other deformation yet shimmed to improve the sealing functions, and thus a maintenance-free keeper blade that rarely if ever needs replacement.

A further object of this invention is a keeper blade that may be made using thicker material and does not require a tool for quick installation.

A still further object of this invention is to have a multifunctional embodiment of the above invention that involves a conductive version of the above keeper blade whereby the keeper blade not only performs the keeper blade function, but also performs the charge roller function, and by being conductive while rubbing against the photoreceptor, provides a charge to the photoreceptor. Prior art charge rollers are round and roll with the photoreceptor, which has been found unnecesary, and thus a stationary multifunctional charging keeper blade may perform both functions. They may be conductive throughout or may be coated with a conductive material.

In carrying out this invention in the illustrative embodiment therof, a resilient stiffener is attached along the length of the keeper blade on the side of the keeper blade facing away from the photoreceptor drum. The stiffener is then used to secure the keeper blade to the waste toner hopper. By selecting the width of the stiffener, it may be used as a shim to set the distance between the keeper blade and the drum and control the efficiency of the seal. The stiffener may be made of a heat conductive material so it conducts heat away from the keeper blade to prevent failure or warpage of the blade caused by excessive heat generated during continuous operation of the imaging machine. An alternative embodiment has the keeper blade made of or coated with a heat conductive material to prevent this heat distortion.

Imaging machines should be designed with an extra space for a stiffener and rubber keeper blade. Thus, some technicians may choose to shim it while others may not as a matter of choice. However, if it is spaced closely in design without the stiffener, the technician can not move the blade further away.

BRIEF DESCRIPTION OF THE DRAWINGS

This invention, together with other objects, features, aspects, and advantages thereof, will be more clearly understood from the following description, considered in conjunction with the accompanying drawings.

FIG. 1 shows the waste toner hopper section of a conventional toner cartridge assembly.

FIG. 2 is a broad illustration of the location of the photoreceptor drum relative to the waste toner hopper.

FIG. 3 shows a keeper blade stiffener of this invention.

FIG. 4 is an enlarged end view of the stiffener with adhesive illustrated on the sides which set the width of the stiffener.

FIG. 5 shows an enlarged end view of the stiffener with two-side tape to attach the stiffener to the keeper blade and waste toner hopper.

COMPLETE DESCRIPTION OF THE PREFERRED EMBODIMENT

Figure 6:
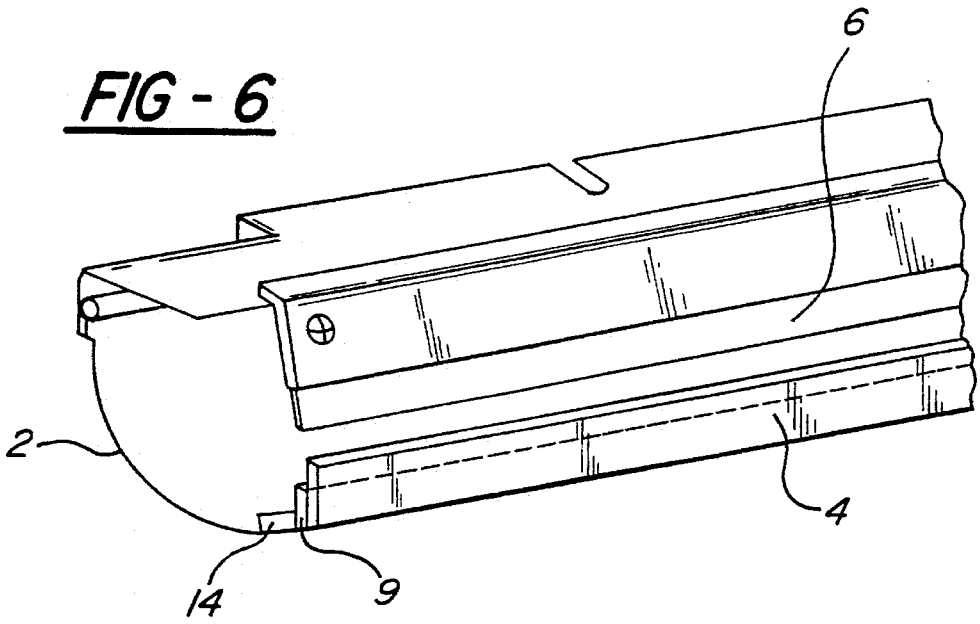
FIG. 6 illustrates where the stiffener is attached relative to the keeper blade and waste toner hopper.

FIG. 1 shows a section 1 of a conventional toner cartridge assembly for use in imaging machines such as printers, copiers and facsimile machines. A waste toner hopper 2 is part of the assembly and is located adjacent the photoreceptor drum 3 as illustrated broadly in FIG. 2. After transferring the dry toner image from the drum 3 to the output paper during the printing process, the photoreceptor drum 3 continues its rotation. Residual toner on the drum 3 is in contact with the keeper or recovery blade 4, forming a perfect seal so toner will not leak out, yet allowing the toner to fall into the waste toner hopper 2, "keeping" it in the waste toner hopper 2 so it can't escape. As the drum continues to rotate, the cutting edge 5 of the wiper blade 6 scrapes the residual toner from the photoreceptor drum 3. The toner falls through the slot 7 into the waste toner hopper 2. The scraped-off residual toner cannot leak or penetrate into the rest of the cartridge assembly because of the seal-contact maintained between the edge 5 of the wiper blade 6 and the photoreceptor drum 3. Also, toner, in theory, cannot leak from the waste toner hopper 2 to the remainder of the cartridge assembly because of the seal provided through the keeper blade 4 and the drum 3.

The keeper blade 4 in prior art is made of either a thin, stiff plastic or a thin resilient rubber material from three to five thousandths of an inch thick. The plastic may be acetate, MYLAR, polycarbonate or other stiff plastic. The rubber material may be urethane, neoprene or other type of rubber.

Some waste toner hoppers 2 are designed so the keeper blade 4 is very close to the photoreceptor drum 3. The keeper blade 4 may be so close to the drum 3 that as the drum 3 rotates, the keeper blade 4 may inadvertently scrape residual toner off the drum 3 before it is scraped off by the edge 5 of the wiper blade 6 to fall into the waste toner hopper 2.

Residual toner prematurely scraped off the drum 3 can leak into the remainder of the toner cartridge assembly, making a mess of other components and affecting the quality of the print on the output paper. Having the keeper blade 4 too close or tight to the drum 3 may also cause excess friction or heat, in turn causing premature wear or warpage of the drum 3 and keeper blade 4.

It has been observed in some cases that a small bead or pencil-line of toner forms and remains along the keeper blade 4. But the toner bead does not increase in size as the page count increases. It stays fairly consistent. However, when the toner cartridge assembly is removed from the imaging machine, the thin bead of toner may leak into the remainder of the assembly, or into the office environment. A narrow strip of magnet 8, about one-thirtysecond of an inch thick and three-thirtyseconds of an inch in width, used in some waste toner hoppers may attract some of the toner when the toner cartridge assembly is pulled out of the imaging machine and the bead of toner falls off the keeper blade 4. Note that, as shown in FIG. 2, the keeper blade 4 touches an edge of the magnet 8, and the magnet 8 also helps secure the keeper blade 4 to the waste toner hopper 2. But the problems of keeper blade 4 warpage and toner leakage persist. Attempting to vacuum or otherwise clean the keeper blade 4 can cause it to kink.

In other types of waste toner hoppers 2, the keeper blade 4 is spaced further from the photoreceptor drum 3. But seal problems may develop with this design, especially after the keeper blade loses its resilience from prolonged use which may include heat and friction, it may "mold" to the shape of the round photoreceptor drum, without the stiffener.

FIG. 3 shows a keeper blade stiffener 9 of this invention created to solve the above problems. The stiffener 9 comprises a thin, stiff, resilient length of plastic or metal. As illustrated in the enlarged end view of the stiffener 9 in FIG. 4, the two sides 10 and 11 of the stiffener 9, which set the width of the stiffener 9, are covered with an adhesive 12. The adhesive 12 may be glue, caulk, or other conventional adhesives. Or, as represented in FIG. 5, two-sided tape 13 may be used. The adhesive 12 or two-sided tape 13 are for attaching the stiffener 9 to the keeper blade 4 and then securing the stiffener 9 along with the keeper blade 4 to the waste toner hopper 2.

As illustrated in FIG. 6, one side 10 or 11 of the stiffener 9 is attached to the toner hopper 2 at location 14. Then the keeper blade 4 is attached to the other side 10 or 11 of the stiffener 9 to secure the keeper blade 4 into position on the waste toner hopper 2. The stiffener 9 improves the seal between the keeper blade 4 and the photoreceptor drum 3 by preventing the keeper blade 4 from flexing away from the drum 3 during operation of the imaging machine. The stiffener 9 also prevents the keeper blade 4 from kinking when the keeper blade 4 is vacuumed, and subject to suction while vacuuming the waste toner hopper 2. The stiffener 9 also prevents the keeper blade 4 from kinking or becoming bent when other maintenance is performed on the keeper blade 4 and adjacent cartridge assembly components. The stiffener 9 may also act as a shim between the keeper blade 4 and the attach area 14, thus positioning the keeper blade 4 closer to the photoreceptor drum 3 to improve the seal performance, to improve the keeper blade longevity, and to allow the keeper blade 4 to increase seal-contact with the photoreceptor 3 and to replace the charge roller in another embodiment of this invention.

The stiffener 9 may be made of a heat conductive plastic or metal to conduct heat away from the keeper blade 4. In this way, the keeper blade 4 will not warp from excessive heat generated during repeated friction in operation of the imaging machine. The thickness of the stiffener 9 may be selected such that the stiffener 9 acts as a shim in setting the distance between the keeper blade 4 and the photoreceptor drum 3. This allows the technician to control the efficiency of the seal and allows the keeper blade 4 to be moved closer to the drum 3 in waste toner hoppers 2 where the keeper blade 4 is spaced at a greater distance from the drum 3.

Figure 7:
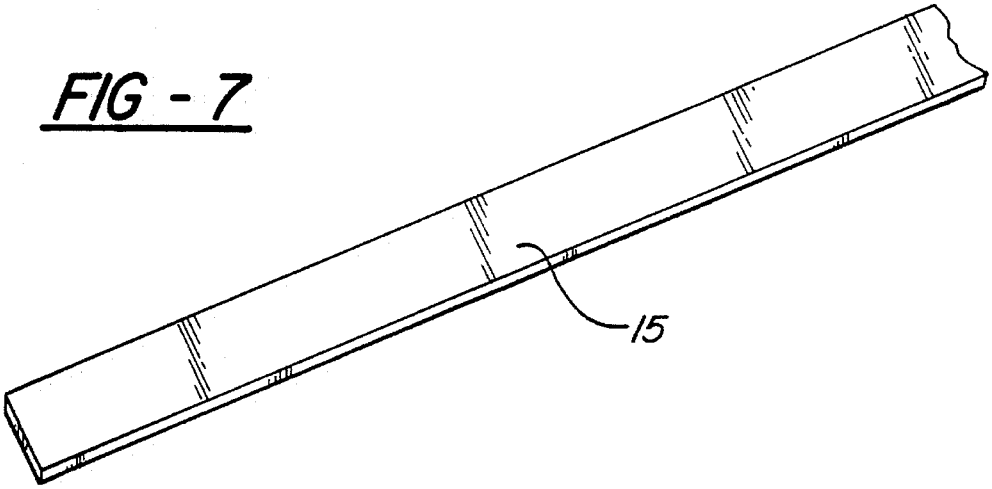
FIG. 7 shows a keeper blade improved by having it made from a heat conductive material.
Figure 8:
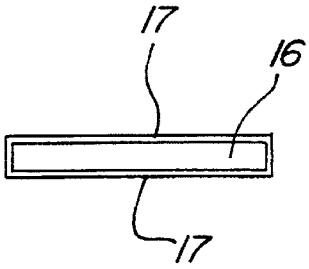
FIG. 8 is an enlarged end view of a keeper blade coated with a heat conductive material.

As an alternative in preventing the warpage or failure of the keeper blade due to excessive heat generated during repeated operation of the imaging machine, FIG. 7 shows a keeper blade 15 made from a heat conductive material, such as heat conductive urethane rubber. Heat would be conducted away from the keeper blade 15. Or, as illustrated by FIG. 8, an enlarged end view of a keeper blade 16, the keeper blade may be coated with a heat conductive material 17 such as polytetrafluoroethylene (TEFLON) or urethane, in any case using graphite, carbon black, or a mixture of the two. Ser. No. 08/267,000 filed by applicant on Jun. 27, 1994, discloses such a coating that is conductive that may be used to coat the keeper blade to make it conductive. A spray coating such as spray paint of aluminum, copper, gold, silver, or other metallic color contains enough conductive metallic particles to conduct some heat and electricity. Also, the urethane rubber may be impregnated with bits of metal, carbon black, graphite, or a combination of any of these materials, very fine material so as not to be abrasive, to conduct heat and electricity. The heat conductive materials will prevent the keeper blades 15 and 16 from quickly losing their resilience from hot-cold cycles of the imaging machine. The conductive keeper blades 15 and 16 could be used with or without a stiffener 9.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. An improved keeper blade for a waste toner hopper of a toner cartridge assembly used in imaging machines, the improvement comprising a stiffener having first and second sides, said first side for attaching said stiffener to said waste toner hopper and said second side for securing said keeper blade to said stiffener.

2. An improved keeper blade as in claim 1 wherein said stiffener extends along said keeper blade.

3. An improved keeper blade as in claim 1 wherein said stiffener is made of a stiff material whereby said keeper blade will not kink or otherwise deform during cleaning or other maintenance.

4. An improved keeper blade as in claim 3 wherein said stiff material is heat conductive whereby said stiffener conducts heat away from said keeper blade, preventing warpage or failure of said keeper blade.

5. An improved keeper blade as in claim 4 wherein a photoreceptor drum is adjacent said waste toner hopper in said toner cartridge assembly, and said stiffener has a thickness selected to set a desired seal-pressure between said keeper blade and said photoreceptor drum, whereby said stiffener acts as a shim.

6. An improved keeper blade as in claim 1 wherein said stiffener is made of a conductive material whereby said stiffener conducts heat away from said keeper blade, preventing warpage or failure of said keeper blade.

7. An improved keeper blade as in claim 1 wherein a photoreceptor drum is adjacent said waste toner hopper in said cartridge assembly, and said stiffener has a thickness selected to set a desired seal-pressure between said keeper blade and said photoreceptor drum, whereby said stiffener acts as a shim.

8. An improved keeper blade as in claim 1 wherein said stiffener is a resilient plastic.

9. An improved keeper blade as in claim 1 wherein said stiffener is a resilient metal.

10. An improved keeper blade an in claim 1 wherein an adhesive is applied on each of said first and second sides of said stiffener, said adhesive being used to attach said stiffener to said keeper blade and secure said stiffener and said keeper blade to said waste toner hopper.

11. An improved keeper blade as in claim 10 wherein said adhesive is glue or similar means.

12. An improved keeper blade as in claim 10 wherein said adhesive is two-sided tape.

13. An improved keeper blade for a waste toner hopper of a toner cartridge assembly used in imaging machines, said improved keeper blade being made of or being coated by a conductive material, whereby said keeper blade will not warp or lose resilience during repeated operation of said imaging machines.

14. An improved keeper blade as in claim 13 wherein said heat conductive material is heat conductive urethane.

15. An improved keeper blade as in claim 13 wherein said conductive material is a conductive polytetrafluoroethylene made conductive with a fine graphite powder.

16. A multifunctional keeper blade as in claim 13 whereby said conductive keeper blade is charged with electricity which will in turn charges the photoreceptor for a more efficient imaging device that no longer needs a corona wire nor a charge roller assembly to charge the photoreceptor and thus has less moving parts and saves in manufacturing costs.

17. A method for stiffening a keeper blade for a waste toner hopper of a toner cartridge assembly used in imaging machines, said method comprising removing said keeper blade from said waste toner hopper, attaching a stiffener to said keeper blade, and then using said stiffener to resecure said keeper blade to said waste toner hopper.

18. A method for stiffening a keeper blade as in claim 17 wherein an adhesive is used to attach said stiffener to said keeper blade and resecure said stiffener with said keeper blade to said waste toner hopper.

19. A method for stiffening a keeper blade as in claim 18 wherein said adhesive is glue or like means.

20. A method for stiffening a keeper blade as in claim 18 wherein said adhesive is two-sided tape.

* * * * *